US008104696B2

(12) United States Patent
Wang

(10) Patent No.: US 8,104,696 B2
(45) Date of Patent: Jan. 31, 2012

(54) ROTARY SPRAY NOZZLE FOR SPRAY GUNS

(76) Inventor: King Yuan Wang, Changhua Hsien (TW)

( * ) Notice: Subject to any disclaimer, the term of this patent is extended or adjusted under 35 U.S.C. 154(b) by 23 days.

(21) Appl. No.: 11/902,523

(22) Filed: Sep. 21, 2007

(65) Prior Publication Data

US 2011/0220741 A1 Sep. 15, 2011

(51) Int. Cl.
*B05B 1/32* (2006.01)

(52) U.S. Cl. ..... 239/458; 239/252

(58) Field of Classification Search ..... 239/451–460, 239/225.1, 230, 237, 240, 245, 247, 248, 239/252
See application file for complete search history.

(56) References Cited

U.S. PATENT DOCUMENTS 3,130,919 A * 4/1964 Baker ..... 239/546
3,244,376 A * 4/1966 Thompson ..... 239/458
4,171,097 A * 10/1979 Rebold ..... 239/341
5,421,517 A * 6/1995 Knudson et al. ..... 239/225.1
6,360,966 B1 * 3/2002 Wang ..... 239/225.1

* cited by examiner

*Primary Examiner* — Davis Hwu
(74) *Attorney, Agent, or Firm* — Chi IP Law Firm

(57) ABSTRACT

A rotary spray nozzle for spray guns comprises a metallic outer housing and a plastic assembling element wherein the metallic outer housing has a hollow chamber disposed at one side to accommodate the plastic assembling element therein, a water-emitting port disposed at the other side to fluidly connect to the hollow chamber, and a ringed water-blocking seat protruding between the hollow chamber and the water-emitting port. The plastic assembling element, formed a hollow extending there-through, is molded similarly to the hollow chamber and equipped with an internal-threaded portion therein to secure to an external-threaded section defining a water-outlet cylinder of a gun body. The plastic assembling element also has a reverse-stop ring extending at the middle section to restrict the position of a sealing ring mounted to the water-outlet cylinder thereof, achieving anti-leaking and anti-loosing benefits as well as simplifying the structure and manufacturing process of the present invention thereby.

17 Claims, 7 Drawing Sheets

ROTARY SPRAY NOZZLE FOR SPRAY GUNS

BACKGROUND OF THE INVENTION

The present invention relates to a rotary spray nozzle for spray guns, comprising a metallic outer housing and a plastic assembling element that are mounted together to form a rotary spray head wherein the metallic outer housing is equipped with a hollow chamber to accommodate and fix the plastic assembling element therein, economically simplifying the structure and the manufacturing process to reduce the cost of production and achieve standardized production thereby.

Please refer to FIG. 7. One conventional spray nozzle 10 utilized by spray guns is integrally molded via metallic material, whose manufacturing process (e.g. threaded and cut operations) can take a long time and boost the cost of production thereby. Thus, the conventional spray nozzle 10 can't achieve standardized mass production, which makes it quite uncompetitive on the market. Besides, the spray nozzle 10 is equipped with an annular groove 11 molded via lathing operation which features an inaccuracy and can easily come up with flawed products. And, a stop ring 20 can easily come off or inaccurately mount to the annular groove 11 thereof. In case the spray nozzle 10 is erroneously assembled onto a gun body 30, the spray gun can lose its function and its defective rate is easily increased.

To overcome the disadvantages of the aforementioned conventional spray nozzle 10, an improve spray nozzle is revealed in a Taiwan Patent No. 454574 and a U.S. Pat. No. 6,360,966 wherein plastic material is utilized and ejection-molded into a housing 40 (referring to FIG. 8) and an inner sleeve 50 that are further assembled into a spray head. Despite the saving of cost and time relative to the lathing operations involved in the above metallic spray nozzle, the housing 40 of said spray nozzle, however, has the interior equipped with a sleeve groove 41, a water-emitting slope 42, an oblique abutting surface 43, and a sliding section 44 therein so as to match to the stepwise design of the inner sleeve 50 thereby. Therefore, said spray nozzle features a complicated structure and fits only for the manufacturing of plastic material. In case the housing 40 is to be molded via, metallic material, the complex internal structure of the housing 40 will take a lot of time in an uneconomical manner. Thus, said improved spray nozzle is quite limited by the material applied thereof.

SUMMARY OF THE PRESENT INVENTION

It is, therefore, the primary purpose of the present invention to provide a rotary spray nozzle for spray guns wherein a metallic outer housing and a plastic assembling element are utilized and mounted together to form a rotary spray head wherein the metallic outer housing simply requires a hollow chamber defining therein to accommodate and fix the plastic assembling element therein, economically simplifying the structure and the manufacturing process thereof to reduce both cost and time of the processing and achieve standardized production so as to boost the competitiveness of the present invention on the market thereby.

DETAILED DESCRIPTION OF THE PREFERRED EMBODIMENTS

Figure 1:
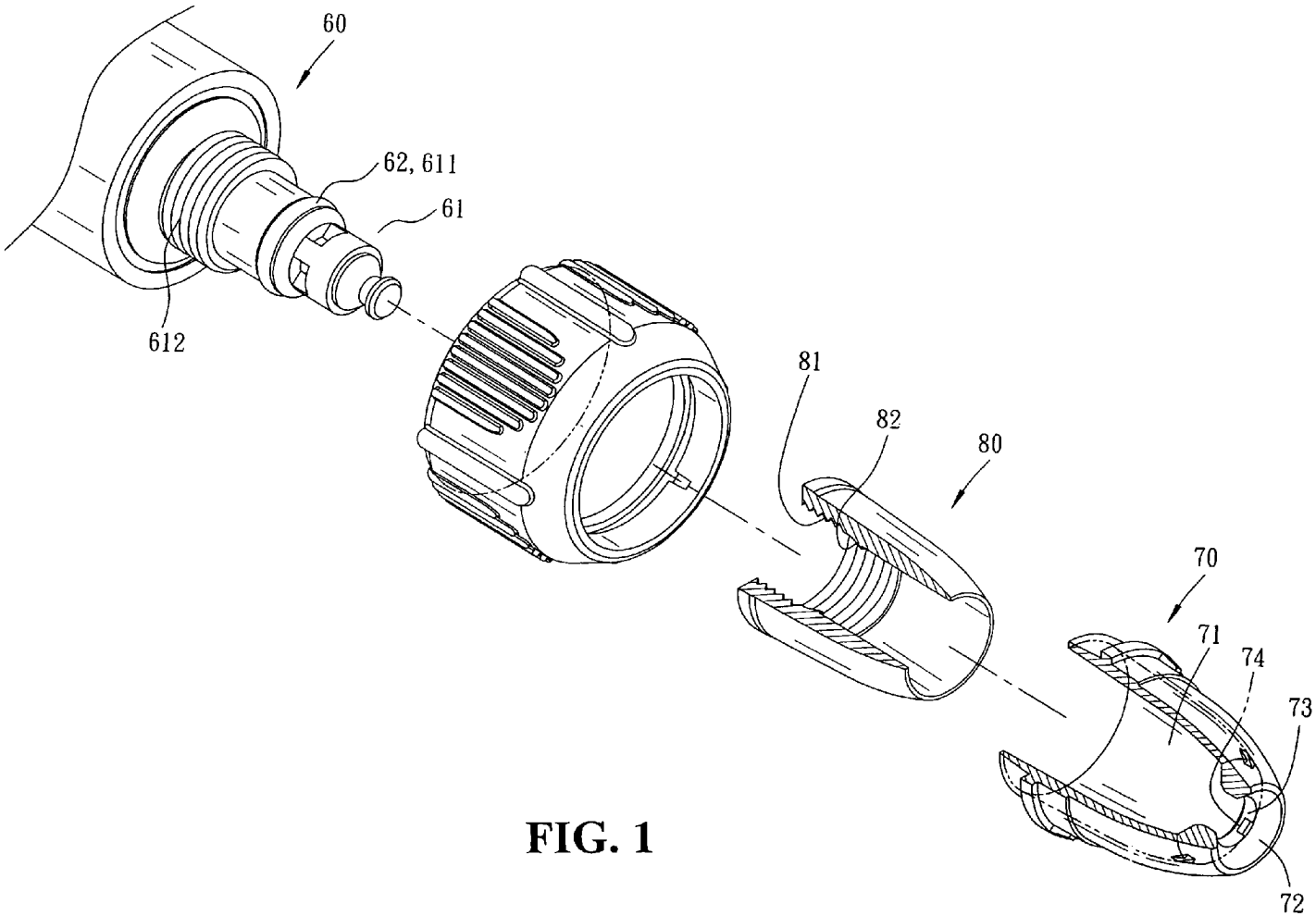
FIG. 1 is an exploded perspective view of the present invention.

Please refer to FIG. 1 showing an exploded perspective view of the present invention. The present invention relates to a rotary spray nozzle for spray guns wherein a gun body 60 is equipped with a water-outlet cylinder 61 having an anti-loosing annular groove 611 defining thereon to which a sealing ring 62 is securely mounted thereon. The water-outlet cylinder 61 also includes an external-threaded section 612 defining thereon to secure to a rotary spray head thereby and form a spray gun therewith. The rotary spray head is composed of a metallic outer housing 70 and a plastic assembling element 80. The metallic outer housing 70 has one side defined by a wide-to-narrow tapered and conical-shaped hollow chamber 71 therein and the other side equipped with a gradually-expanding water-emitting port 72 to fluidly connect to the hollow chamber 71 thereby. The metallic outer housing 70 also has a ringed water-blocking seat 73 protruding between the hollow chamber 71 and the water-emitting port 72, and multiple protrusive ribs 74 annularly arranged at the internal surface of the water-blocking seat 73 and the hollow chamber 71 thereon. The plastic assembling element 80, formed a hollow extending there-through, is similarly molded in the shape of the hollow chamber 71 but has a depth slightly shorter than that of the hollow chamber 71 thereof. The plastic assembling element 80 has an internal-threaded portion 81 defining the inner surface of one end thereon to fit to the external-threaded section 612 of the water-outlet cylinder 61 thereby. Besides, the plastic assembling element 80 also has a reverse-stop ring 82 extending at the internal middle section thereon.

Figure 2:
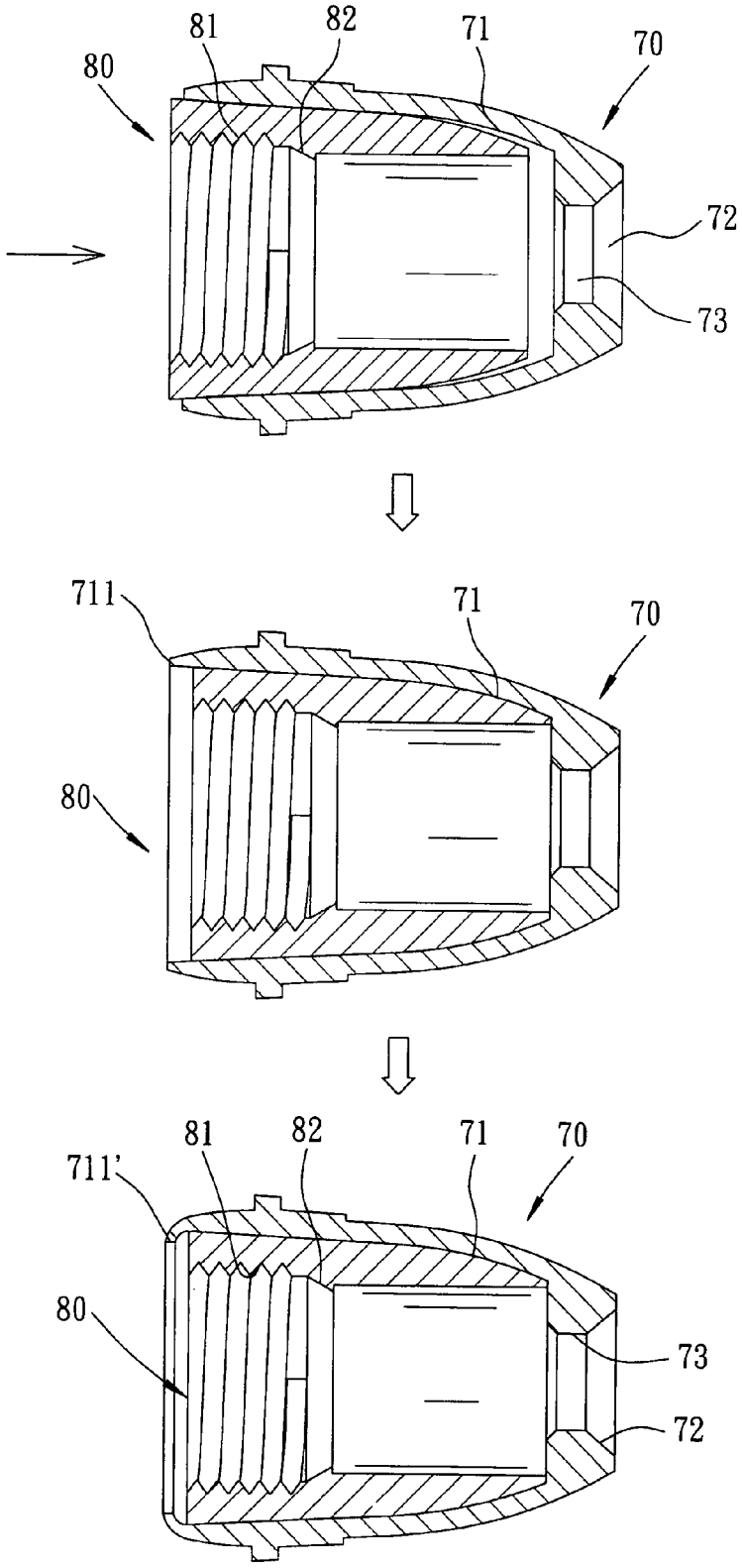
FIG. 2 is a diagram showing the assembling process of a rotary spray head of the present invention.
Figure 3:
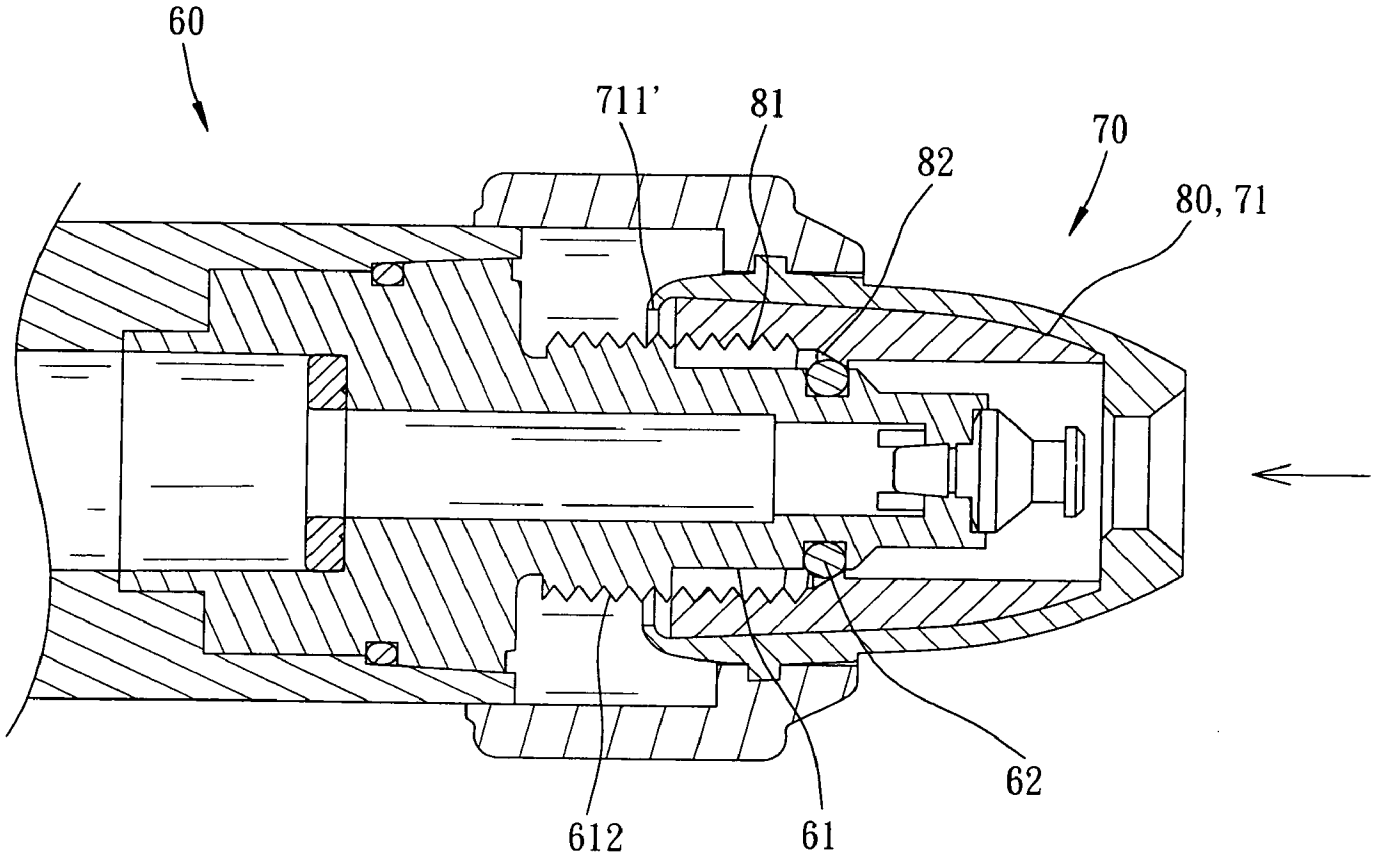
FIG. 3 is a diagram showing the rotary spray head of the present invention mounted to a water-outlet cylinder.
Figure 4:
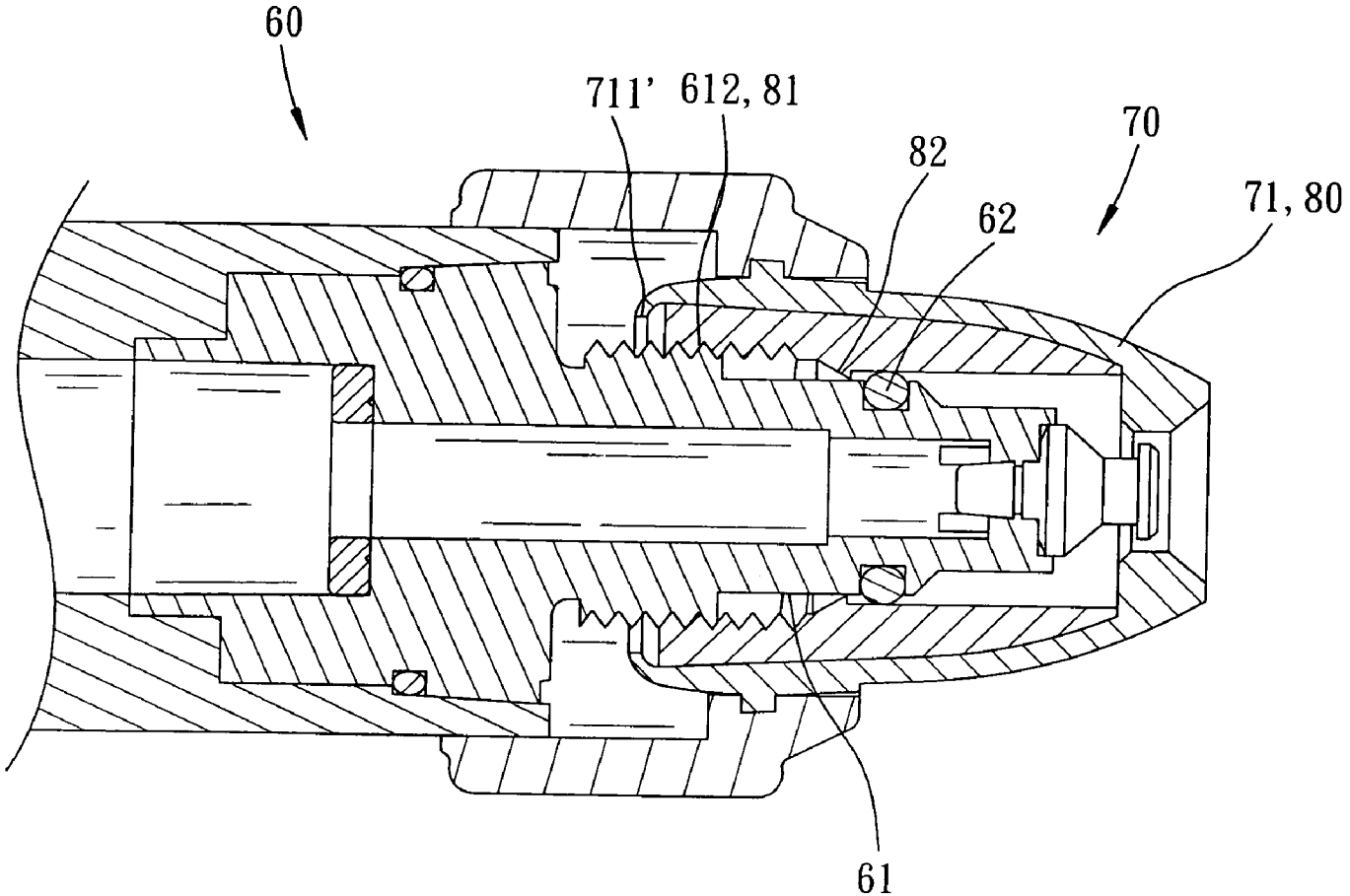
FIG. 4 is an assembled cross sectional view of the rotary spray head of the present invention mounted to the water-outlet cylinder till a sealing ring securely abutting against the internal surface of a plastic assembling element and restricted in position by a reverse-stop ring thereof.
Figure 5:
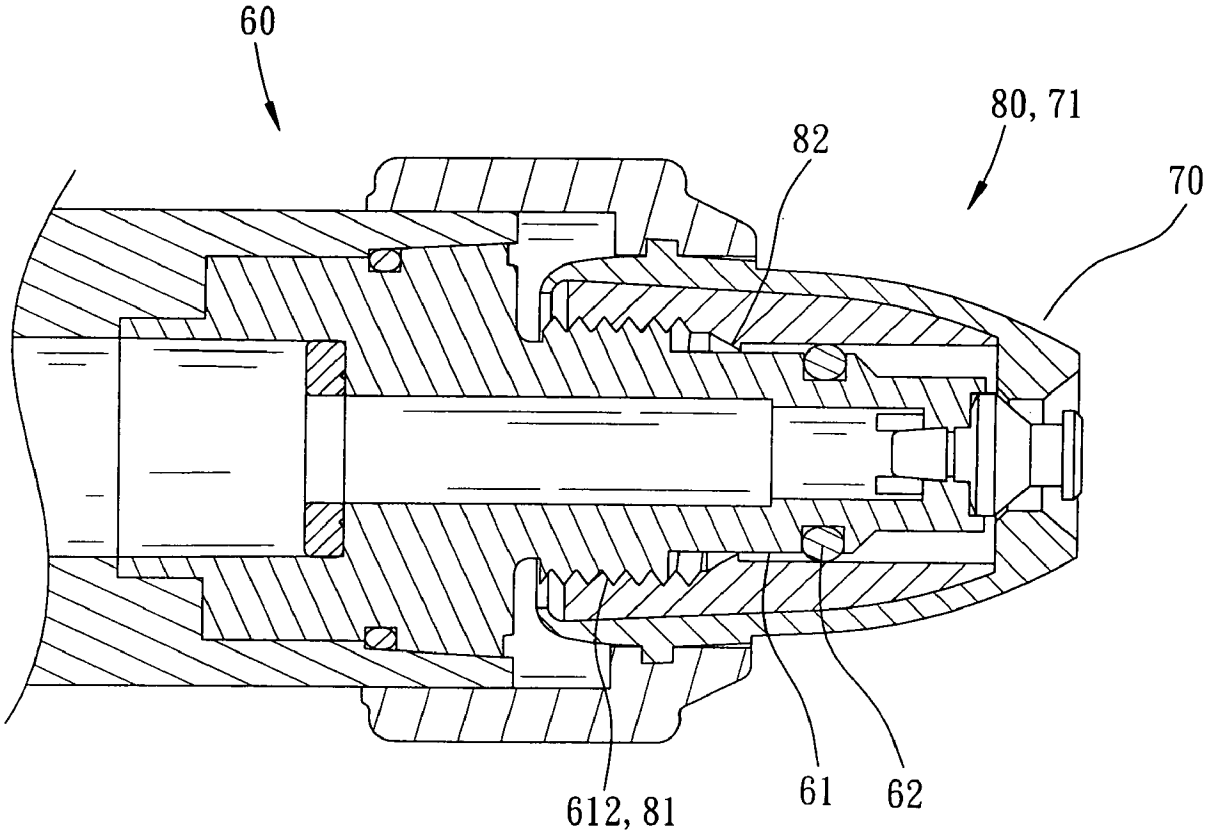
FIG. 5 is a diagram showing the rotary spray head completely secured to the water-outlet cylinder in the minimum water-emitting state thereof.

In assembly (referring to FIG. 2), the plastic assembling element 80 is first squeezed into the hollow chamber 71 of the metallic outer housing 70 and forced into place with its surface securely binding with the protrusive ribs 74 thereof. Meanwhile, the plastic assembling element 80 having a shorter length relative to that of the hollow chamber 71 is utilized to preset a riveting section 711 that can be punched via riveting operation to form a stop flange 711' extending at the bottom section of the plastic assembling element 80 so as to restrict the position of the plastic assembling element 80 fixed inside the hollow chamber 71, completing the assembly of the rotary spray head thereby. Then, the plastic assembling element 80 of the rotary spray head (referring to FIG. 3) is guided to the water-outlet cylinder 61 of the gun body 60 and squeezed thereto by force so that the reverse-stop ring 82 is allowed to slide along the sealing ring 62 till the sealing ring 62 is forced to abut tight against the internal surface of the plastic assembling element 80 and restricted in position by the reverse-stop ring 82 thereof, completing the assembly of the present invention. Thus, the internal-threaded portion 81 of the plastic assembling element 80 (referring to FIG. 4) can be adjustably secured to the external-threaded section 612 of the water-outlet cylinder 61 to alter the distance between the water-outlet cylinder 61 and the water-blocking seat 73 thereof so as to control the amount of water-discharge thereby. When the internal-threaded portion 81 of the plastic assembling element 80 is completely secured to the external-threaded section 612 of the water-outlet cylinder 61 (referring to FIG. 5), the water discharge can be regulated to emit in the minimum state. Furthermore, the sealing ring 62 is utilized to abut tight and close against the internal surface of the plastic assembling element 80 and to be restricted in position by the reverse-stop ring 82 thereof so as to provide anti-leaking and anti-loosing benefits and achieve the best application state thereby.

Figure 6:
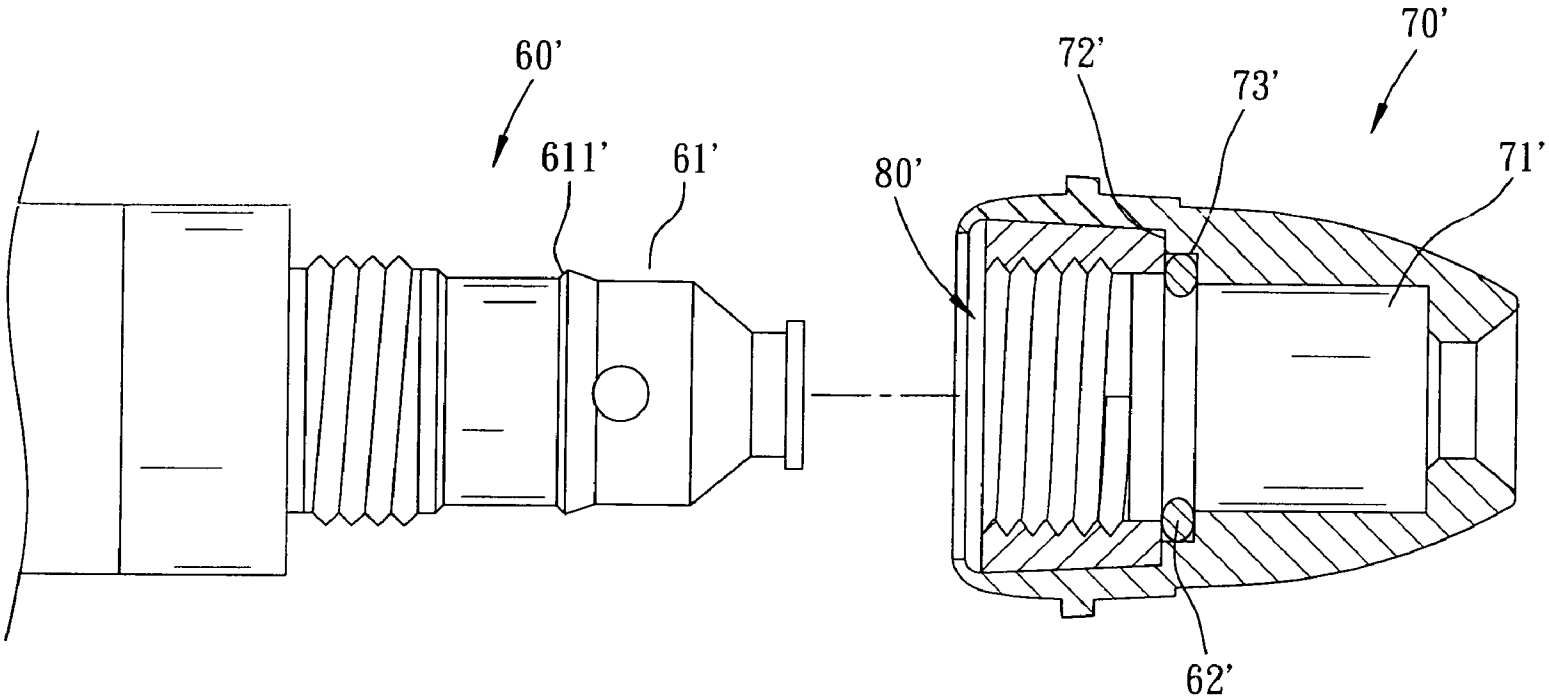
FIG. 6 is an assembled cross sectional view of another embodiment of the rotary spray head of the present invention
Figure 8:
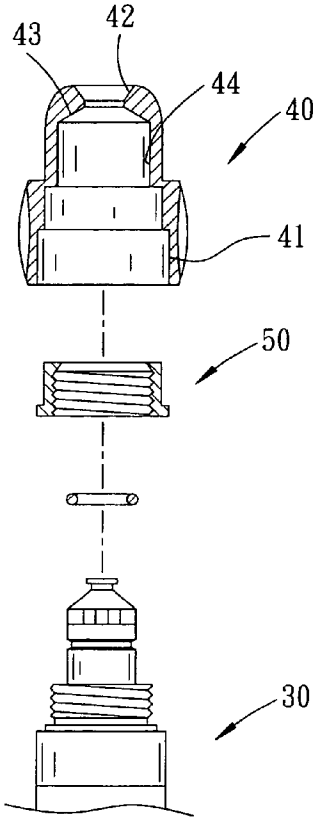
FIG. 8 PRIOR ART
FIG. 8 is an exploded cross sectional view of another conventional rotary spray nozzle.
Figure 7:
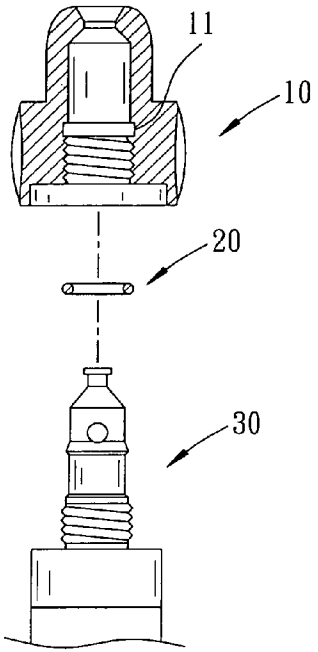
FIG. 7 PRIOR ART
FIG. 7 is an exploded cross sectional view of a conventional rotary spray nozzle.

Please refer to FIG. 6. The present invention can also include a gun body 60' having a water-outlet cylinder 61' with a reverse-stop ring 611' protruding thereon. A metallic outer housing 70' is equipped with a hollow chamber 71' therein with a stepwise stop seat 72' extending at the upper section thereon against which a plastic assembling element 80' is abutted and positioned thereby. The metallic outer housing 70' also has an annular groove 73' defining therein to which a sealing ring 62' is mounted and fixed thereto, permitting the sealing ring 62' to protrude at the internal surface of the hollow chamber 71' and to be precisely restricted in position by the reverse-stop ring 611' thereof.

What is claimed is:

1. A rotary spray nozzle for spray guns comprising, a metallic outer housing; and a plastic assembling element, wherein the metallic outer housing has a hollow chamber to fluidly connect to a water-emitting port for accommodating and securing the plastic assembling element therein, wherein the metallic outer housing and the plastic assembling element form a rotary spray head thereby, wherein the plastic assembling element, forming a hollow extending there-through, has an internal-threaded portion defining an interior thereon to secure to an external-threaded section defining a water-outlet cylinder of a gun body thereby, wherein the plastic assembling element has a depth slightly shorter than that of the hollow chamber of the metallic outer housing so as to preset a riveting section to be punched via riveting operation to form a stop flange extending at a bottom section of the plastic assembling element, and wherein the plastic assembling element being restricted in position and secured inside the hollow chamber thereof.

2. The rotary spray nozzle for spray guns as claimed in claim 1 wherein the metallic outer housing has a ringed water-blocking seat protruding between the hollow chamber and the water-emitting port.

3. The rotary spray nozzle for spray guns as claimed in claim 1 wherein the hollow chamber of the metallic outer housing is molded in a wide-to-narrow tapered and conical-shaped configuration.

4. The rotary spray nozzle for spray guns as claimed in claim 1 wherein the water-emitting port of the metallic outer housing is molded in a sequentially-expanding form.

5. The rotary spray nozzle for spray guns as claimed in claim 1 wherein the water-outlet cylinder of the gun body has an anti-loosing annular groove defining thereon to which a sealing ring is securely mounted thereon, and wherein the plastic assembling element has the interior equipped with a reverse-stop ring to precisely block and restrict the position of the sealing ring, for achieving anti-leaking and anti-loosing benefits.

6. The rotary spray nozzle for spray guns as claimed in claim 5 wherein the plastic assembling element has a depth slightly shorter than that of the hollow chamber of the metallic outer housing so as to preset a riveting section to be punched via riveting operation to form a stop flange extending at the bottom section of the plastic assembling element; for restricting the plastic assembling element in position and for securing the plastic assembling element inside the hollow chamber thereof.

7. The rotary spray nozzle for spray guns as claimed in claim 5 wherein the plastic assembling element has a depth slightly shorter than that of the hollow chamber of the metallic outer housing so as to preset a riveting section to be punched via riveting operation to form a stop flange extending at the bottom section of the plastic assembling element for restricting the plastic assembling element in position and for securing the plastic assembling element inside the hollow chamber thereof.

8. The rotary spray nozzle for spray guns as claimed in claim 1 wherein the water-outlet cylinder of the gun body include a reverse-stop ring protruding thereon, and wherein the metallic outer housing has a hollow chamber with a stepwise stop seat extending at the upper section thereon abutting against the plastic assembling element and disposing in position thereby.

9. The rotary spray nozzle for spray guns as claimed in claim 8 wherein the hollow chamber of the metallic outer housing has an opening end slightly extending downwards at the bottom section of the plastic assembling element so as to preset a riveting section to be punched via riveting operation to form a stop flange extending at the bottom section of the plastic assembling element; for restricting the plastic assembling element in position and for securing the plastic assembling element inside the hollow chamber thereof.

10. The rotary spray nozzle for spray guns as claimed in claim 8 wherein the hollow chamber of the metallic outer housing has an opening end slightly extending downwards at the bottom section of the plastic assembling element so as to preset a riveting section to be punched via riveting operation to form a stop flange extending at the bottom section of the plastic assembling element for restricting the plastic assembling element in position and for securing the plastic assembling element inside the hollow chamber thereof.

11. The rotary spray nozzle for spray guns as claimed in claim 1, wherein the metallic outer housing has an annular groove defining therein for accommodating a sealing ring therein, the annular groove permitting the sealing ring to protrude at the internal surface of the hollow chamber and to be precisely restricted in position by the reverse-stop ring thereof so as to achieve anti-leaking and anti-loosing benefits thereby.

12. The rotary spray nozzle for spray guns as claimed in claim 1 wherein the hollow chamber of the metallic outer housing is molded in a wide-to-narrow tapered and conical-shaped configuration.

13. The rotary spray nozzle for spray guns as claimed in claim 1 wherein the water-emitting port of the metallic outer housing is molded in a sequentially-expanding form.

14. The rotary spray nozzle for spray guns as claimed in claim 1 wherein the water-outlet cylinder of the gun body has an anti-loosing annular groove defining thereon to which a sealing ring is securely mounted thereon, and wherein the plastic assembling element has the interior equipped with a reverse-stop ring to precisely block and restrict the position of the sealing ring for achieving anti-leaking and anti-loosing benefits.

15. The rotary spray nozzle for spray guns as claimed in claim 1 wherein the water-outlet cylinder of the gun body include a reverse-stop ring protruding thereon, and wherein the metallic outer housing has a hollow chamber with a stepwise stop seat extending at the upper section thereon abutting against the plastic assembling element and disposing in position thereby.

16. The rotary spray nozzle for spray guns as claimed in claim 1, wherein the metallic outer housing has an annular groove defining therein for accommodating a sealing ring therein, the annular groove permitting the sealing ring to protrude at the internal surface of the hollow chamber and to be precisely restricted in position by the reverse-stop ring thereof so as to achieve anti-leaking and anti-loosing benefits thereby.

17. A rotary spray nozzle for spray guns comprising, a metallic outer housing; and a plastic assembling element, said plastic assembling element forming a hollow extending there-through;

a hollow chamber of said metallic outer housing for fluidly connecting to a water-emitting port for accommodating and securing the plastic assembling element, said hollow chamber securing the plastic assembling element in position therein, wherein the metallic outer housing has a ringed water-blocking seat protruding between the hollow chamber and the water-emitting port, wherein the plastic assembling element has an internal-threaded portion defining an interior therein to secure to an external-threaded section defining a water-outlet cylinder of a gun body thereby, and wherein the plastic assembling element has a depth slightly shorter than that of the hollow chamber of the metallic outer housing so as to preset a riveting section to be punched via riveting operation to form a stop flange extending at a bottom section of the plastic assembling element.

* * * * *